US008923718B2

(12) United States Patent
Kakehi

(10) Patent No.: US 8,923,718 B2
(45) Date of Patent: Dec. 30, 2014

(54) IMAGE FORMING APPARATUS WHICH PERFORMS CLEANING OF A TRANSFER MATERIAL CONVEYANCE MEMBER

(71) Applicant: Canon Kabushiki Kaisha, Tokyo (JP)

(72) Inventor: Yutaka Kakehi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 18 days.

(21) Appl. No.: 13/712,759

(22) Filed: Dec. 12, 2012

(65) Prior Publication Data

US 2013/0156455 A1 Jun. 20, 2013

(30) Foreign Application Priority Data

Dec. 19, 2011 (JP) ..... 2011-277691

(51) Int. Cl.
*G03G 15/16* (2006.01)
*G03G 15/01* (2006.01)
*G03G 15/18* (2006.01)

(52) U.S. Cl.
CPC ..... *G03G 15/18* (2013.01); *G03G 15/168* (2013.01); *G03G 15/161* (2013.01); *G03G 15/0189* (2013.01)
USPC ..... 399/66; 399/71; 399/101

(58) Field of Classification Search
USPC ..... 399/66, 71, 101, 343, 346, 302, 308
See application file for complete search history.

(56) References Cited

U.S. PATENT DOCUMENTS

| | | | | |
|---|---|---|---|---|
| 5,970,282 | A * | 10/1999 | Yanagida et al. | 399/101 |
| 2011/0222885 | A1* | 9/2011 | Yamaki et al. | 399/66 |
| 2011/0243588 | A1* | 10/2011 | Saida | 399/66 X |
| 2011/0318033 | A1* | 12/2011 | Takayanagi | 399/66 X |
| 2012/0051773 | A1* | 3/2012 | Takahashi | 399/66 X |
| 2013/0051832 | A1* | 2/2013 | Aiba | 399/71 |

FOREIGN PATENT DOCUMENTS

| | | | |
|---|---|---|---|
| JP | 2002-072713 | A | 3/2002 |
| JP | 2005-99215 | A | 4/2005 |

* cited by examiner

*Primary Examiner* — Sophia S Chen
(74) *Attorney, Agent, or Firm* — Canon USA, Inc., IP Division

(57) ABSTRACT

Supply distribution of toner bands is varied in accordance with an image rate. Provided is image forming apparatus includes: an image forming unit; a movable image bearing member; a movable conveying belt; a transfer member; a power supply; a first blade member; a second blade member; and an execution unit.

12 Claims, 6 Drawing Sheets

IMAGE FORMING APPARATUS WHICH PERFORMS CLEANING OF A TRANSFER MATERIAL CONVEYANCE MEMBER

BACKGROUND OF THE INVENTION

1. Field of the Invention

The present invention relates to image forming apparatus in which a toner image on an image bearing member is transferred to a recording material using electrophotographic technology related to, for example, a copier and a laser printer. More particularly, the present invention relates to a technique to stably perform cleaning of a transfer material conveyance member which conveys the image bearing member and a transfer material.

2. Description of the Related Art

There has been a configuration in which an intermediate transfer belt for bearing a toner image to support various recording materials is provided and, in addition to the intermediate transfer belt, a conveying belt which conveys recording materials is provided in order to support a further variety of recording materials. In such a configuration, a nip portion is formed by the intermediate transfer belt and the conveying belt and, in the nip portion, a toner image is transferred from the intermediate transfer belt to the recording material carried by the conveying belt.

However, in the nip portion, a part of the toner is not transferred to the recording material but remains on the intermediate transfer belt. It is therefore necessary to provide a unit to clean a surface of the intermediate transfer belt. There is a possibility that the toner on the intermediate transfer belt adheres to the conveying belt between recording materials. It is therefore necessary to provide a unit to clean the conveying belt.

A related art method for cleaning the belt includes a blade member which is provided in contact with the belt.

However, if the toner is depleted at the position at which the blade and the belt are in contact with each other, there is a possibility that the frictional force becomes excessively large between the blade and the belt. Then there is a possibility that the blade is turned up. Japanese Patent Laid-Open No. 2002-072713 discloses usage of a patch image formed between paper to prevent the frictional force from becoming excessively large between a blade and a belt.

The apparatus described in Japanese Patent Laid-Open No. 2002-072713 includes a blade which is in contact with an intermediate transfer belt and a blade which is in contact with a secondary transfer roller. Two kinds of control are performed in the disclosed apparatus. One of the control is to set the polarity of the voltage to be applied to the secondary transfer portion when the patch image is made to pass the secondary transfer portion to be supplied to the secondary transfer roller to the same polarity as that of the transfer voltage. The other of the control is to set the polarity of the voltage to be applied to the secondary transfer portion when the patch image is made to pass the secondary transfer portion to be supplied to the secondary transfer roller to the polarity opposite to the polarity of the transfer voltage.

Since the toner adheres to the conveying belt basically only between paper, the toner is not easily supplied to the blade of the conveying belt. When the recording material passes the secondary transfer nip, a part of the toner is not transferred to the recording material and remains on the intermediate transfer belt ("residual toner"). That is, the toner is supplied to the blade of the intermediate transfer belt by the residual toner.

However, the amount of the residual toner varies depending on the image rate of the toner image formed on the recording material. That is, since the amount of the residual toner increases if the toner image of high image rate is formed, there is a possibility that toner supply to the blade of the intermediate transfer belt becomes excessively large. Conversely, since the amount of the residual toner decreases if the toner image of low image rate is formed, there is a possibility that toner supply to the blade of the intermediate transfer belt becomes excessively small.

SUMMARY OF THE INVENTION

Image forming apparatus of the present invention includes: an image forming unit configured to form a toner image; a movable image bearing member configured to bear the toner image formed by the image forming unit; a movable conveying belt configured to convey a recording material; a transfer member configured to transfer, in a transfer portion, the toner image from the image bearing member to the recording material which is conveyed by the conveying belt; a power supply configured to set voltage to the transfer member; a first blade member disposed downstream of the transfer portion and upstream of the image forming unit in a direction in which the image bearing member moves and configured to be in contact with the image bearing member; a second blade member configured to be in contact with the conveying belt; and an execution unit configured to form a toner band in a non-image area existing between image areas of the image bearing member when the toner images are formed continuously and to execute a toner band mode in which toner band passing voltage, which is the voltage applied to the transfer portion from the power supply when the toner band passes the transfer portion, is set to a predetermined value in accordance with information about toner usage in image formation.

According to the invention of this application, in a configuration in which the intermediate transfer belt and the conveying belt are cleaned with a respective blade, it is possible to prevent the amount of the toner supplied to the intermediate transfer belt becoming excessively large when the image rate is high and prevent toner shortage at the blade of the intermediate transfer belt when the image rate is low while the toner band is supplied to the conveying belt. A further object of the present invention will be obvious from the following description.

Further features of the present invention will become apparent from the following description of exemplary embodiments with reference to the attached drawings.

DESCRIPTION OF THE EMBODIMENTS

Embodiment 1

Image Formation Process

Figure 1:
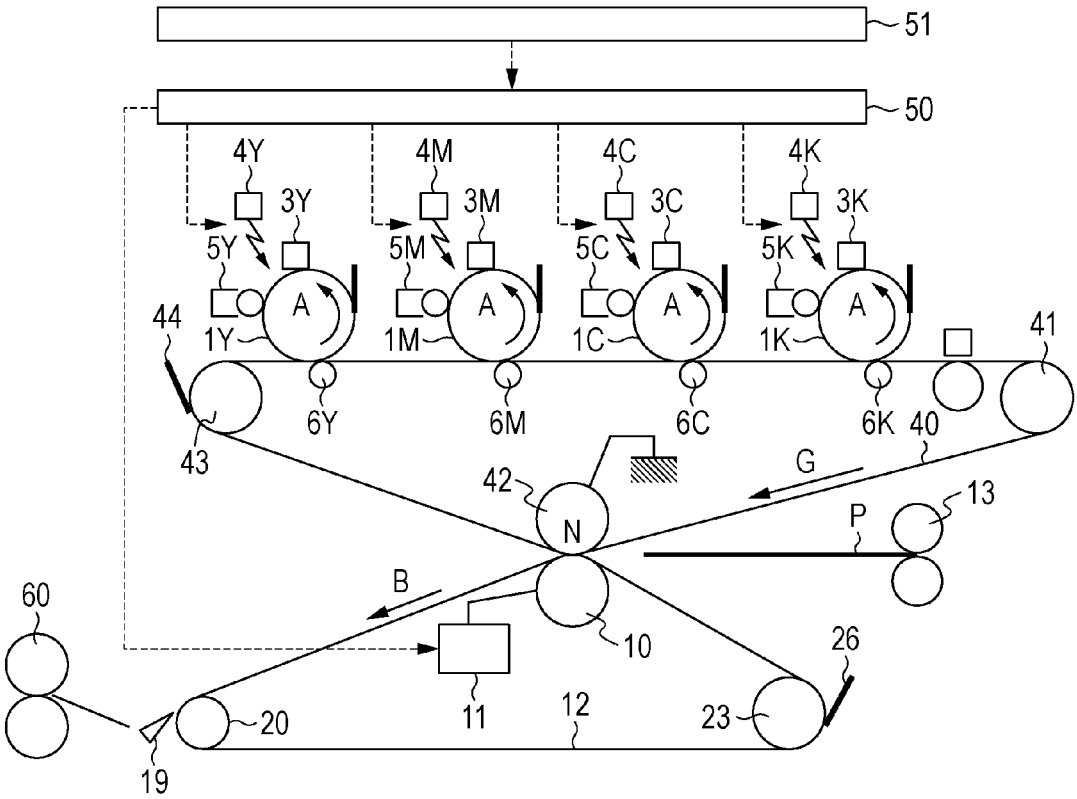
FIG. 1 is a diagram illustrating a first embodiment.

An image formation process of image forming apparatus of the present embodiment will be described with reference to FIG. 1. The reference numerals 1Y, 1M, 1C and 1K denote photosensitive drums as image bearing members for bearing toner images. The photosensitive drums 1Y, 1M, 1C and 1K rotate in the direction of the arrow A and surfaces thereof are uniformly charged by primary charging devices 3Y, 3M, 3C and 3K. The reference numerals 4Y, 4M, 4C and 4K denote exposure devices which perform exposure in accordance with image information. Electrostatic latent images in accordance with the image information are formed on the photosensitive drums 1Y, 1M, 1C and 1K in a well-known electrophotographic process.

Developing units 5Y, 5M, 5C and 5K which develop the toner image each include yellow (Y), magenta (M) and cyan (C), which are color toner, and black (K) toner. The electrostatic latent images are developed by the developing units 5Y, 5M, 5C and 5K and the toner images are formed on the surfaces of the photosensitive drums 1Y, 1M, 1C and 1K. The development system here is the reversal development system in which toner is made to adhere to an exposed area of the electrostatic latent image and a tone image is developed.

Each of the electrostatic latent images formed by the exposure devices 4Y, 4M, 4C and 4K is a collection of small dot images. The exposure devices 4Y, 4M, 4C and 4K adjust density of the dot images. Therefore, a carrying amount of toner per unit area is adjusted and the density of the toner image formed on the photosensitive drums 1Y, 1M, 1C and 1K can be changed. In the present embodiment, the maximum density of the toner image of each color is about 1.5 to 1.7. If the density of the toner image is the maximum density, the carrying amount of toner per unit area is about 0.4 to 0.6 $mg/cm^2$.

The toner images on the photosensitive drums 1Y, 1M, 1C and 1K are transferred to an intermediate transfer belt 40 by primary transfer rollers 6Y, 6M, 6C and 6K. That is, the primary transfer rollers 6Y, 6M, 6C and 6K function as primarily transfer members which transfer the toner images to the intermediate transfer belt 40. The toner images of each color are made to overlap one another on the intermediate transfer belt 40 to form a color image. The intermediate transfer belt 40 is disposed to be in contact with the surfaces of the photosensitive drums 1Y, 1M, 1C and 1K. The intermediate transfer belt 40 is a belt member stretched over a plurality of tension rollers 41, 42 and 43. The intermediate transfer belt 40 is movable in the direction of arrow G at the speed of 250 to 300 mm/sec. The intermediate transfer belt tension roller 41 is a tension roller which maintains the tension of the intermediate transfer belt 40. The intermediate transfer belt tension roller 43 is the driving roller which drives the intermediate transfer belt 40 to move. The intermediate transfer belt tension roller 42 is a counter roller which faces a secondary transfer roller 10 that transfers the toner image to a recording material. The intermediate transfer belt 40 is formed by resin, such as polyimide and polycarbonate, or rubber, which includes a certain amount of Carbon Black as an antistatic additive. The intermediate transfer belt 40 has the volume resistivity of 1E+9 to 1E+14 Ω·cm and the thickness of 0.07 to 0.1 mm. The volume resistivity and the thickness are not restrictive.

The reference numeral 12 denotes a secondary transfer belt which conveys the recording material. The secondary transfer belt 12 is a belt member which is stretched over the secondary transfer roller 10 and a plurality of tension rollers 20 and 23. The secondary transfer belt 12 is movable in the direction of the arrow B at the speed of 250 to 300 mm/sec. The tension roller 20 is a separation roller which separates a recording material P from the secondary transfer belt 12. The separation roller 20 is a roller made of stainless steel of which outer diameter is 12 to 16 mm. The secondary transfer belt 12 is formed by resin, such as polyimide and polycarbonate, or various rubber, which includes a certain amount of Carbon Black as an antistatic additive. The secondary transfer belt 12 has the volume resistivity of 1E+9 to 1E+14 Ω·cm and the thickness is 0.07 to 0.1 mm. A value of the Young's modulus measured by a tension test (JIS K 6301) is about equal to or greater than 100 MPa and not equal to or smaller than 10 GPa, which is sufficiently hard.

The recording material P is stopped temporarily by a registration roller 13 and is conveyed to the secondary transfer belt 12 in synchronization with the toner image on the intermediate transfer belt 40 being moved.

When the secondary transfer belt 12 is moved in the direction of arrow B, the recording material P reaches a secondary transfer nip N formed by the intermediate transfer belt tension roller 42 and the secondary transfer roller 10. When the recording material is conveyed to the secondary transfer nip N, a secondary transfer current of which polarity is opposite to that of the toner is applied to the secondary transfer roller 10. Therefore, the toner image on the intermediate transfer belt 40 is collectively transferred electrostatically to the recording material P. That is, the secondary roller 10 functions as a secondary transfer member which transfers the toner image to the recording material. The secondary transfer nip N functions as a secondary transfer portion which transfers the toner image to the recording material. At this time, the recording material is electrostatically adsorbed by the electrostatic force to the secondary transfer belt 12. Since the polarity of the toner is negative in the present embodiment, the polarity of the transfer voltage which transfers the toner image to the recording material is positive. A voltage value of transfer voltage is set such that a current of +40 to 60 uA flows through the secondary transfer roller 10 when secondary transfer of the toner to the recording material is carried out.

The secondary transfer roller 10 is formed by an elastic layer made of ionic conductive foamed rubber (NBR rubber) and core metal. The secondary transfer roller 10 has an outer diameter of 24 mm, roller surface roughness Rz of 6.0 to 12.0 (micrometers), resistance of 1E+5 to 1E+7 Ω in the measurement of N/N (23 degrees C, 50% RH) under the voltage of 2 kV. A secondary transfer high-voltage power supply 11 which supplies voltage is connected to the secondary transfer roller 10. That is, the secondary transfer high-voltage power supply 11 functions as a voltage applying unit which applies voltage to the secondary transfer member.

The recording material separated from the secondary transfer belt 12 by the separation roller 20 after the transfer is carried to a fusing device 60. After the toner image is fused to the recording material by the fusing device 60, the recording material is discharged out of the apparatus. A separation claw 19 is provided between the separation roller 20 and the fusing device along the direction in which the recording material is conveyed. The separation claw 19 assists separation of the recording material P from the secondary transfer belt 12 and guides the recording material toward the fusing device 60.

Configuration for Cleaning

Toner remains on the intermediate transfer belt 40 after the secondary transfer ("residual toner"). Then, in order to clean the intermediate transfer belt 40, an intermediate transfer belt cleaning device 44 is disposed downstream of the secondary transfer portion N in the direction in which the intermediate transfer belt 40 is moved.

There is a case in which paper powder adheres to the secondary transfer belt 12 or, if a paper jam occurs between recording materials, there is a case in which the toner adheres to the secondary transfer belt 12 from the intermediate transfer belt 40 in the secondary transfer portion N. Then, in order to clean the secondary transfer belt 12, a secondary transfer belt cleaning device 26 is disposed downstream of the secondary transfer portion N in the direction in which the secondary transfer belt 12 is moved.

The intermediate transfer belt cleaning device 44 includes an elastic blade which is in contact with the intermediate transfer belt 40. The secondary transfer belt cleaning device 26 includes an elastic blade which is in contact with the secondary transfer belt 12. These elastic blades are made of urethane rubber. Blade tips are in contact with the intermediate transfer belt 40 and the secondary transfer belt 12 in the direction opposite to the moving direction of these belts.

That is, the present embodiment includes a blade for cleaning the intermediate transfer belt 40 ("first blade member") and a blade for cleaning the secondary transfer belt 12 ("second blade member").

In order to improve the cleaning performance of the blade, it is desirable to improve closeness in contact between the blade and the intermediate transfer belt 40. However, if the friction between the blade and the intermediate transfer belt 40 or the friction between the blade and the secondary transfer belt 12 becomes excessively large while the intermediate transfer belt 40 and the secondary transfer belt 12 are in motion, blade tips are drawn in the direction in which the intermediate transfer belt 40 and the secondary transfer belt 12 are moving. Then, there is a possibility that the blade tips are turned up. Then, in order to prevent turning-up of the blades due to excessively large frictional force, lubricant such as fluoridation carbon is applied to the blades at portions in contact with the intermediate transfer belt 40 and the secondary transfer belt 12 at the time of product shipment.

However, if the intermediate transfer belt 40 and the secondary transfer belt 12 are driven for a long period of time, the lubricant which had been applied at the time of product shipment is scraped off due to the friction between the blade and the intermediate transfer belt 40 and the friction between the blade and the secondary transfer belt 12. There is therefore a possibility that the frictional force becomes excessively large and the blade is turned up. That is, it is desirable to supply the lubricant.

Control to Supply Toner Band

Then, in the present embodiment, in order to prevent turning-up of the blade of the intermediate transfer belt cleaning device 44 and the blade of the secondary transfer belt cleaning device 26, control to supply a toner band as lubricant is carried out.

That is, a toner band is formed on each of the photosensitive drums 1Y, 1M, 1C and 1K in a non-image formation area which is a space between image formation areas. Since the toner band supplied to the blade functions as the lubricant, turning-up of the blade can be prevented.

In the present embodiment, control to supply the toner band as the lubricant is carried out in accordance with the toner usage to form an image to be transferred to the recording material. The reason for which is discussed below.

Fogging toner on the intermediate transfer belt 40 adheres to the secondary transfer belt 12 in a non-image formation area existing, for example, between paper. However, since the amount of the fogging toner is small, the toner does not easily adhere to the blade of the secondary transfer belt 12. When the recording material passes the secondary transfer nip N, a part of the toner is not transferred to the recording material and remains on the intermediate transfer belt 40 ("residual toner"). That is, the toner is supplied to the blade of the intermediate transfer belt 40 by the residual toner.

However, the amount of the residual toner varies depending on the toner usage to form the image to be transferred to the recording material. The toner usage is dependent on the image rate of the toner image formed on the recording material. Since the amount of the residual toner increases if the toner image of high image rate is formed, there is a possibility that toner supply to the blade of the intermediate transfer belt 40 becomes excessively large. Conversely, since the amount of the residual toner decreases if the toner image of low image rate is formed, there is a possibility that toner supply to the blade of the intermediate transfer belt 40 becomes excessively small.

Then, in the present embodiment, the supply of the toner band to the intermediate transfer belt 40 is reduced if the image rate is high and the supply of the toner band to the intermediate transfer belt 40 is increased if the image rate is low.

As a result, in a configuration in which the intermediate transfer belt 40 and the secondary transfer belt 12 are cleaned with a respective blade, it is possible to prevent the amount of the toner supplied to the intermediate transfer belt 40 becoming excessively large when the image rate is high and prevent toner shortage at the blade of the intermediate transfer belt 40 when the image rate is low while the toner band is supplied to the secondary transfer belt 12.

The image rate is acquired from output image information. That is, the output image information is converted into image density data in accordance with a look-up table (LUT) in consideration of printer characteristics. The image density data is converted into binary data and is counted. As a result, a video count value corresponding to a single image is acquired. The image rate is calculated from the video count value.

Figure 2:
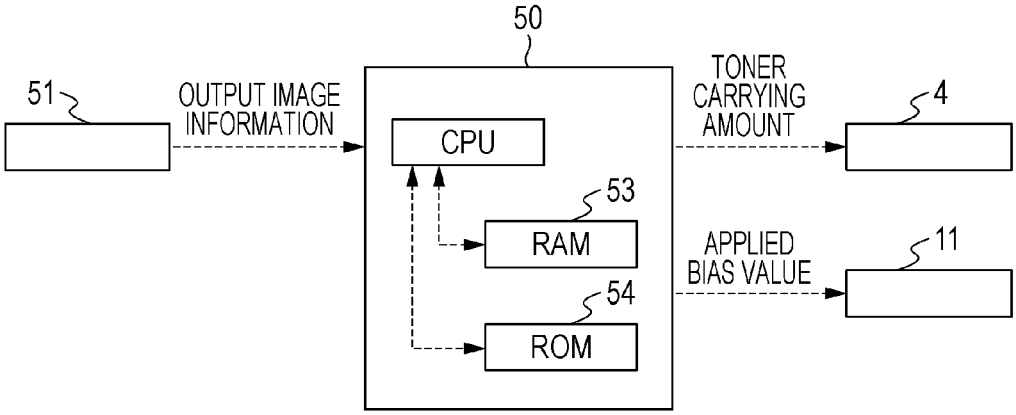
FIG. 2 is a block diagram of the first embodiment.

Next, details of the control to supply the toner band as the lubricant will be described with reference to FIGS. 2 to 5. The control to supply the toner band is controlled by a control circuit 50. The control circuit 50 includes a CPU, RAM and ROM. FIG. 2 illustrates a relationship between input in and output from the control circuit 50. That is, output image information is input in the control circuit 50 using a scanner 51 which reads a document. The control circuit 50 sends an output value of a toner carrying amount to the exposure devices 4Y, 4M, 4C and 4K and sends an output value of the voltage to the secondary transfer high-voltage power supply.

Supply of the toner band is carried out whenever a specified number (200 sheets) of the toner images for output are formed. That is, after the previous toner band is formed, when the cumulative total number of the toner images to be transferred to the recording material has reached the specified number, the next toner band is formed. Since the toner band is not supplied constantly, excessive toner consumption is prevented. Further, time for control for the supply of the toner band is shortened.

Figure 3:
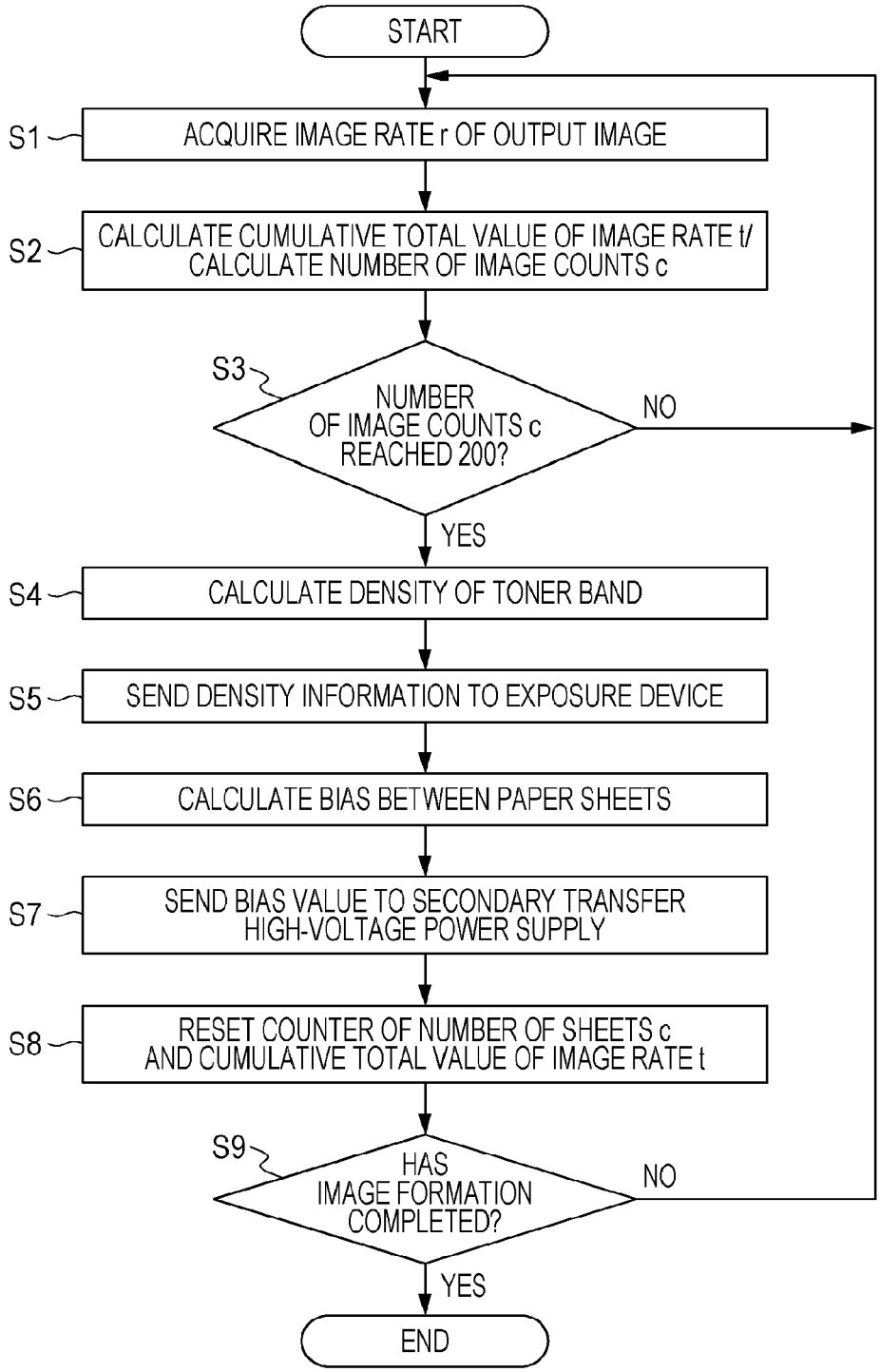
FIG. 3 is a flowchart of the first embodiment.

FIG. 3 is a flowchart illustrating the control of the control circuit 50.

When the control is started, the scanner 51 reads a document image and sends the output image information to the control circuit 50. In S1, the control circuit 50 acquires an image rate value r of an output image in accordance with the output image information. The toner usage is determined on the basis of the image rate value. That is, the control circuit 50 functions also as a determination unit which acquires the image rate value r in accordance with the output image and determines the toner usage. The control circuit 50 writes the acquired image rate value r in the RAM 53. Furthermore, the control circuit 50 calculates the number of image counts c which represents how many images has been output after the previous toner band is formed and a cumulative total value t of the image rate which represents the total number of the image rate values after the previous toner band is formed, and records the calculated values in the RAM 53 (S2).

In S3, it is determined whether the number of the output images after the previous toner band is formed has reached the specified number (c=200). If the number of image counts has not reached 200, the process returns to S1 and the image rate of the next output image is acquired. That is, calculation of the number of image counts and the cumulative total value of the image rate is continued until the number of image counts reaches 200. As a result, the cumulative total number of the image rate until the number of output images reaches 200 after the previous toner band is formed is calculated.

If the number of image counts reaches 200 in S3, density of the toner band formed on each of the photosensitive drums 1Y, 1M, 1C and 1K is determined in S4. Here, the control circuit 50 determines the density of the toner band with reference to the cumulative total value of the image rate recorded in the RAM 53 and the relationship illustrated in FIG. 4. The relationship illustrated in FIG. 4 is recorded in the ROM 54 and is the relationship between the density of the toner band and the cumulative total number of the image rate.

Figure 4:
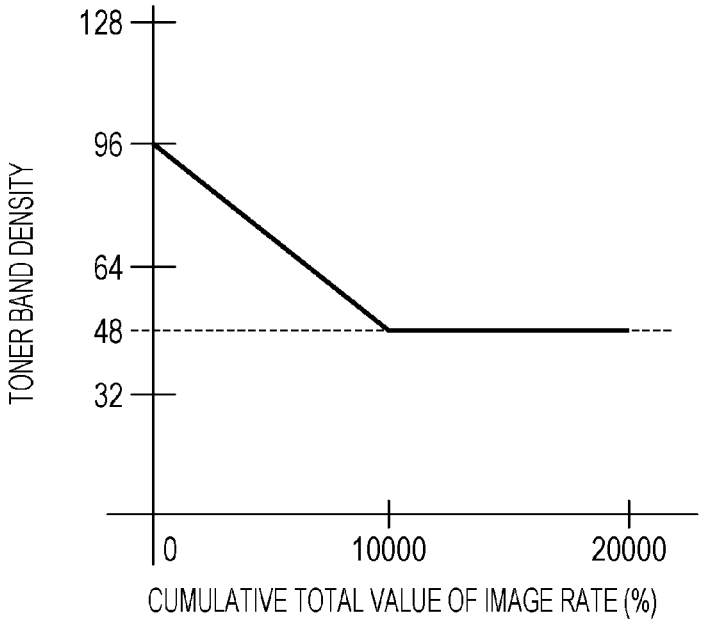
FIG. 4 is a diagram illustrating control of the first embodiment.

The horizontal axis of FIG. 4 corresponds to the cumulative total value (%) of the image rate written in the RAM 53. The vertical axis of FIG. 4 corresponds to the density when the density gradation of the toner image which can be formed on the photosensitive drum 1 is expressed by 255 tones. The density of the toner image is adjusted by changing the carrying amount per unit area.

For example, if 200 images of which image rate is 0% are continuously formed after the previous toner band is formed, the cumulative total value of the image rate is calculated to be 0×200=0%. In this case, after the previous toner band is formed, 0% is written in the RAM 53 as the cumulative total value of the output image. In this case, the density of the toner band corresponding to 0% of the cumulative total value of the image rate with reference to FIG. 4 is 96. That is, the control circuit 50 calculates the density of the toner band to be 96.

For example, if 200 images of which image rate is 50% are continuously formed after the previous toner band is formed, the cumulative total number of the image rate is calculated to be 50%×200=10000%. In this case, after the previous toner band is formed, 10000% is written in the RAM 53 as the cumulative total value of the image rate of the output image. In this case, with reference to FIG. 4, the density of the toner band corresponding to 10000% of the cumulative total value of the image rate is 48. That is, the control circuit 50 calculates the density of the toner band to be 48.

In the present embodiment, in a range in which the cumulative total value of the image rate is equal to or greater than 0% and equal to or lower than 10000%, the control circuit 50 determines the toner carrying amount per unit area of the toner band such that the density of the toner band become low as the cumulative total value of the image rate becomes high. In a range in which the cumulative total value of the image rate is equal to or greater than a predetermined value, i.e., equal to or greater than 10000%, the control circuit 50 determines the density of the toner band, i.e., the toner carrying amount per unit area, such that the density of the toner band becomes 48 which is a constant value irrespective of the cumulative total value of the image rate.

Then, information about the toner carrying amount corresponding to the density of the toner band determined in S4 is sent to the exposure devices 4Y, 4M, 4C and 4K such that the toner bands of desired density can be formed on the photosensitive drums 1Y, 1M, 1C and 1K (S5).

Figure 5:
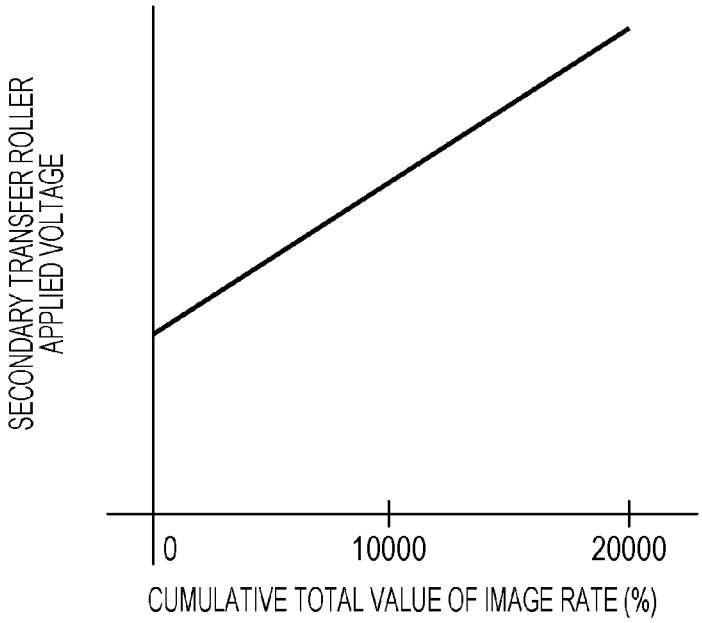
FIG. 5 is a diagram illustrating control of the first embodiment and a second embodiment.

In S6, voltage which the secondary transfer high-voltage power supply 11 applies to the secondary transfer roller 10 when the toner band passes the secondary transfer nip N is calculated in accordance with the relationship illustrated in FIG. 5. FIG. 5 illustrates the relationship between the voltage applied by the secondary transfer high-voltage power supply 11 and the cumulative total value of the image rate recorded in the ROM 54. The horizontal axis of FIG. 5 corresponds to the cumulative total value of the image rate written in RAM 53 and represents the cumulative total number of the image rate until the number of the output images reaches 200 after the previous toner band is formed. The vertical axis of FIG. 5 corresponds to the voltage ("bias between paper") which the secondary transfer high-voltage power supply 11 applies to the secondary transfer roller when the toner band passes the secondary transfer nip N. For example, if the cumulative total value of the image rate is 0%, the control circuit 50 determines the positive voltage ("bias between paper") such that the current of 5 to 10 uA flows. For example, if the cumulative total value of the image rate is 20000%, the control circuit 50 sets the positive voltage ("bias between paper") such that the current which flows through the secondary transfer nip N is 10 to 20 uA. In the present embodiment, as described above, as the image rate becomes high, the current which flows through the secondary transfer nip N becomes large. That is, as the cumulative total value of the image rate becomes large, the bias between paper becomes large. That is, if the cumulative total value of the image rate is small, voltage of positive polarity and with a smaller absolute value is applied and, if cumulative total value of the image rate is large, voltage of positive polarity and with a larger absolute value is applied. Then, the control circuit 50 sends the calculated output value of the bias between paper to the secondary transfer high-voltage power supply 11 (S7). The reason of setting the voltage to be applied to the secondary transfer roller 10 in this manner will be described.

The higher the image rate, the greater the amount of the residual toner which remains on the intermediate transfer belt 40 when the toner image of the output image passes the secondary transfer nip N. If, as a result, the amount of the residual toner is excessively large, there is a possibility that the residual toner passes through the intermediate transfer belt 40 cleaning device 44 and causes insufficient cleaning. Then, in order to prevent insufficient cleaning of the intermediate transfer belt apparatus 44, it is necessary to reduce the amount of toner band which remains on the intermediate transfer belt 40.

The lower the image rate, the smaller the amount of the residual toner on the intermediate transfer belt 40. If, as a result, the amount of the residual toner is excessively small, the residual toner which is supplied to the blade of the intermediate transfer belt apparatus 44 is eliminated and a possibility of turning-up of the blade becomes high.

Since the toner adheres to the secondary transfer belt 12 basically only between paper, the amount of the toner which adheres to the blade of the secondary transfer belt cleaning device 26 is smaller than the toner which adheres to the intermediate transfer belt cleaning device 44. That is, since a possibility of turning-up of the blade of the secondary transfer belt cleaning device 26 is high, it is necessary to constantly supply a sufficient amount of toner band irrespective of the image rate.

Then, in the present embodiment, the polarity of the voltage which is applied to the secondary transfer roller 10 is set to be opposite to that of the toner when the toner band passes the secondary transfer portion N in order to supply a sufficient amount of the toner band to the secondary transfer belt 12.

Further, if the image rate is small, in order to prevent turning-up of the blade of the intermediate transfer belt cleaning device 44, the toner amount is increased when the cumulative total value of the image rate becomes small. That is, since the density of the toner is changed as necessary, an excessive increase in the amount of consumption of the toner can be prevented.

Then, the number of the counter and the cumulative total value of the image rate are reset to 0 (S8). In S9, it is determined whether the image formation has been completed. If the image formation has been completed, the process is completed. If the image formation has not been continued, the process returns to S1.

That is, in the present embodiment, the density of the toner band formed between paper and the voltage applied to the secondary transfer roller 10 are switched in accordance with the image rate. That is, the amount of the toner band to be left on the intermediate transfer belt 40 and the amount of the toner band to be transferred to the secondary transfer belt 12 are switched.

As a result, in a configuration in which the intermediate transfer belt 40 and the secondary transfer belt 12 are cleaned with a respective blade, it is possible to prevent the amount of the toner supplied to the intermediate transfer belt 40 becoming excessively large when the image rate is high and prevent toner shortage at the blade of the intermediate transfer belt 40 when the image rate is low while the toner band is supplied to the secondary transfer belt 12.

In the present embodiment, the frequency at which the toner band is formed in the space between recording materials is once in 200 sheets. However, this configuration is not restrictive. The frequency at which the toner band is formed can be suitably set in consideration of the control of toner consumption or shortening of control time. The toner band may be formed between all the paper sheets.

In the present embodiment, the toner band to be formed has the length of about 10 mm in the moving direction of the intermediate transfer belt 40 and the width of 323 to 330 mm in the width direction which is vertical to the moving direction of the intermediate transfer belt 40. The width of the blade of the belt cleaning device 26 and the width of the blade of the intermediate transfer belt 40 cleaning device 44 in the width direction are 340 mm. That is, in the width direction, the width of the toner band is shorter than the blade width by about 5 to 7 mm. However, in the width direction, since the toner flows in the direction of ends of the blade, turning-up of the blade can be reduced also at the ends of the blade.

In the present embodiment, in order to adjust the amount of the toner band to be supplied, the shape of the toner band is fixed and the density of the toner band is changed. However, this configuration is not restrictive. In order to adjust the amount of the toner band to be supplied, the length of the toner band in the moving direction of the intermediate transfer belt 40 may be changed. That is, a ratio of the amount of the toner band to be supplied to the intermediate transfer belt 40 between the amount of the toner band to be supplied to the secondary transfer belt may be adjusted.

In the present embodiment, the image rate is calculated in order to determine the amount of the toner usage. However, this configuration is not restrictive. The toner usage may be determined using a cumulative value of video count.

In the present embodiment, the toner usage for forming the output image is determined in accordance with the image rate value. However, this configuration is not restrictive. The toner usage for forming the output image varies for recording materials of different dimensions even if the image rate is the same. Then, in order to determine the toner usage, the dimension of the recording material may be further considered. In that case, the toner usage is determined in accordance with a value obtained by multiplying the image rate by the dimension of the recording material. That is, if the value obtained by multiplying the image rate by the dimension of the recording material is large, the amount of the toner band to be supplied to the secondary transfer belt is increased, and if the value obtained by multiplying the image rate by the dimension of the recording material is small, the amount of the toner band to be supplied to the intermediate transfer belt 40 is increased.

In the present embodiment, the absolute value of the voltage applied when the toner band passes the secondary transfer nip N is proportional to the cumulative total value of the image rate. However, this configuration is not restrictive. In a range in which the cumulative total value of the image rate is smaller than the predetermined value, the voltage to be applied may have a second absolute value and, in a range in which the image rate is equal to or greater than the predetermined value, the voltage to be applied may have a first absolute value which is greater than the second absolute value. This configuration is advantageous in simplicity in control.

In the present embodiment, a resin belt is used as the intermediate transfer belt 40, and the secondary transfer belt 12 is used. However, this configuration is not restrictive. An elastic belt may be used as the intermediate transfer belt 40, and the secondary transfer belt 12 may be used. Since the coefficient of friction between the elastic belt and the blade often becomes large, it is desirable to apply the present invention to a configuration in which an elastic belt is used as the intermediate transfer belt 40 and the secondary transfer belt 12 is used.

Embodiment 2

Hereinafter, a second embodiment will be described: description on the configurations common to the first and second embodiments will be omitted and only the difference therebetween will be described. The second embodiment differs from the first embodiment in setting of the carrying amount of toner of the toner band.

In the first embodiment, the carrying amount of toner of the toner band is changed in accordance with the image rate. This is a concept in which priority is given to the supplying, to the blade, of toner which is necessary to prevent turning-up of the blade and, at the same time, to the prevention of unnecessary toner consumption.

However, in order to change the carrying amount of toner of the toner band, control time and control device, such as a sensor, are needed additionally.

Then, in the second embodiment, the carrying amount of toner band is fixed to a sufficient amount while the carrying amount of toner of the toner band is not changed. Although the toner usage is greater than that of the first embodiment, control time is shorter than that of the first embodiment. The initial cost is reduced.

That is, in the present embodiment, the density of the toner band between paper is set to 96 when expressed by 255 tones irrespective of the image rate.

Figure 6:
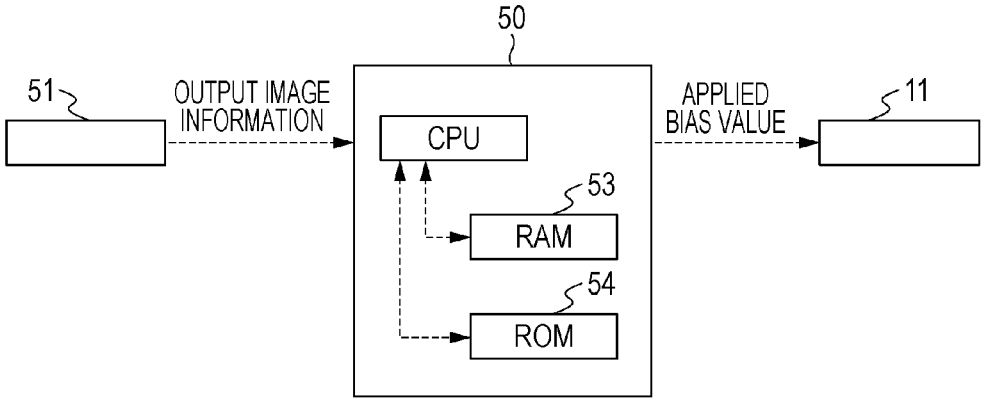
FIG. 6 is a block diagram of the second embodiment.
Figure 7:
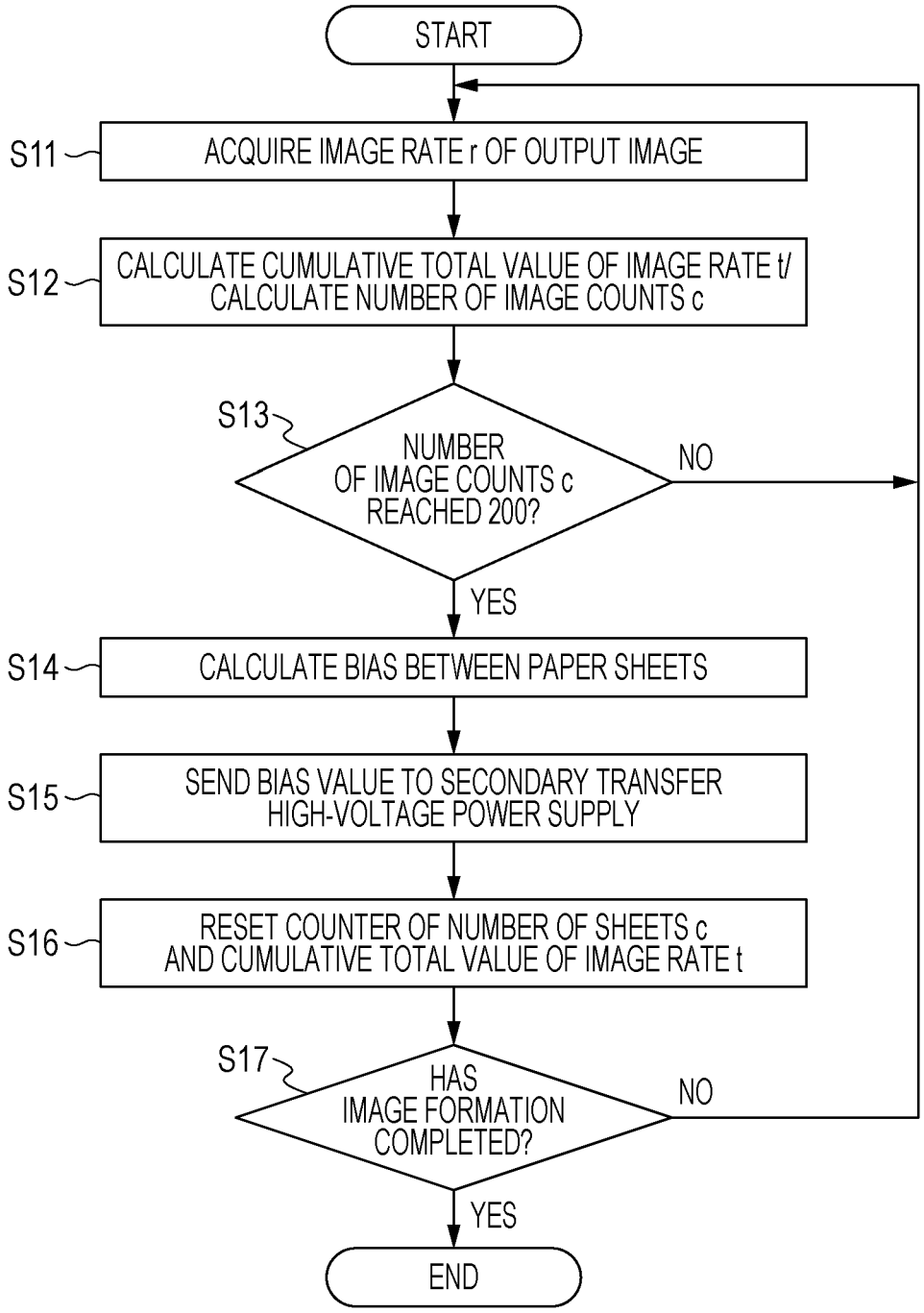
FIG. 7 is a flowchart of the second embodiment.

Details of control by the control circuit 50 will be described with reference to FIGS. 6 and 7. FIG. 6 illustrates a relationship between input in and output from the control circuit 50. That is, output image information is input in the control circuit 50 using a scanner 51 which reads documents. The control circuit 50 sends an output value of the voltage to a secondary transfer high-voltage power supply. FIG. 7 illustrates a flowchart of the setting by the control circuit 50.

The processes from S11 to S13 are the same as those of the first embodiment. If the number of image counts reaches 200 in S13, voltage which the secondary transfer high-voltage power supply 11 applies to the secondary transfer roller 10 when the toner band passes the secondary transfer nip N is calculated (S14) The voltage value is set such that, the larger the cumulative total value of the image rate, the larger the voltage value applied to the secondary transfer roller 10. The set voltage value is sent to the secondary transfer high-voltage power supply 11 (S15).

Details of setting of the voltage will be described. For example, if the cumulative total value of the image rate is 20000%, when the output image is transferred in the secondary transfer nip N, a great amount of toner is supplied to the intermediate transfer belt 40 as residual toner. If the amount of the toner supplied to the blade of the intermediate transfer belt cleaning device 44 is excessively large, there is a possibility that the toner passes through the blade. In order to prevent the toner from passing through the blade of the intermediate transfer belt cleaning device 44, it is desirable to transfer all the toner band from the intermediate transfer belt 40 to the secondary transfer belt 12. Then, in the present embodiment, when the cumulative total value of the image rate is 20000%, bias is applied such that a current of about +20 to 25 uA flows. This voltage value is obtained in the following manner. In the present embodiment, the current value when a solid image of two colors with the density of 255 is transferred is +40 to 60 uA. The current value necessary for the transfer is proportional to the density. The current necessary to transfer the toner bands of four colors with the density of 96 is represented by (the current value of the solid image)×96×4/(255×2). Therefore, the current necessary to transfer all the toner bands of the four colors is 15 to 23 uA. Then, in the present embodiment, in order to transfer all the toner bands sufficiently, the control circuit 50 sets the voltage such that a current of +20 to 25 uA flows.

If the cumulative total value of the image rate is 0%, no residual toner is caused on the intermediate transfer belt 40 when the output image is transferred. It is necessary to apply the voltage to the secondary transfer roller 10 such that the toner may be supplied to each of the secondary transfer belt 12 and the intermediate transfer belt 40. In the present embodiment, voltage is applied to the secondary transfer roller 10 such that the toner of the density value of equal to or greater than 48 which is half the density of the toner band of 96 is transferred to the secondary transfer belt 12. To the secondary transfer belt 12, toner, other than the toner band, is rarely supplied. Therefore, it is desirable that a greater amount of toner is supplied to the secondary transfer belt 12 even if it is necessary to respectively supply the toner bands to the intermediate transfer 40 and the secondary transfer belt 12. Then, in the present embodiment, the control circuit 50 sets the voltage such that the current of about +9 to 14 uA flows when the cumulative total value of the image rate is 0%.

In the present embodiment, the current value when a solid image of secondary color (i.e., two colors) with the density of 255 is transferred is +40 to 60 uA. Therefore, transfer current necessary to transfer the toner bands of four colors with the density of 48 of 255 tones is represented by (the current value of the output image)×48×4/(255'2). That is, the current necessary to transfer half the density of the toner band to the secondary transfer belt is 7.5 to 11.5 uA. Therefore, in the present embodiment, the control circuit 50 determines the voltage such that a current of about +9 to 14 uA flows to supply a sufficient amount of toner to the intermediate transfer belt 40 while supplying equal to or greater than half the amount of the toner band to the secondary transfer belt. Although an embodiment of the present invention has been described, the present invention is not limited to the same: many modifications may be made without departing from the technical idea of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-277691 filed Dec. 19, 2011, which is hereby incorporated by reference herein in its entirety.

What is claimed is:

1. An image forming apparatus, comprising:

an image forming unit configured to form a toner image;

a movable image bearing member configured to bear the toner image formed by the image forming unit;

a movable conveying belt configured to convey a recording material;

a transfer member configured to transfer, in a transfer portion, the toner image from the image bearing member to the recording material which is conveyed by the conveying belt;

a power supply configured to apply a voltage to the transfer member;

a first blade member disposed downstream of the transfer portion and upstream of the image forming unit in a direction in which the image bearing member moves and configured to be in contact with the image bearing member;

a second blade member configured to be in contact with the conveying belt; and an execution unit configured to form a toner band in a non-image area existing between image areas of the image bearing member when toner images are formed continuously, and configured to set a toner band passing voltage so that an absolute value of a first voltage when information about toner usage in an image formation is equal to or greater than a predetermined amount is greater than an absolute value of a second voltage when the formation is smaller than the predetermined amount, wherein the toner band passing voltage is a voltage applied to the transfer member from the power supply when the toner band passes the transfer portion and has the same polarity as that of the voltage applied to the transfer member when the toner image is transferred.

2. The image forming apparatus according to claim 1, wherein the information is in accordance with an image rate of the toner image and the number of formed images with respect to the recording material.

3. The image forming apparatus according to claim 1, wherein the execution unit forms the toner band with first density if the information about the toner usage is equal to or greater than a predetermined value and forms the toner band with second density which is higher than the first density if the information about the toner usage is equal to or smaller than the predetermined value.

4. The image forming apparatus according to claim 1, wherein if the information about the toner usage is equal to or greater than a predetermined value, the execution unit sets the absolute value of the toner band passing voltage applied when the information about the toner usage is a first amount to be greater than the absolute value of the toner band passing voltage applied when the toner usage is a second amount which smaller than the first amount.

5. The image forming apparatus according to claim 1, wherein the image bearing member is an intermediate transfer belt.

6. The image forming apparatus according to claim 1, wherein the predetermined value includes a case in which the toner band passing voltage is OFF.

7. An image forming apparatus, comprising:

an image forming unit configured to form a toner image;

a movable image bearing member configured to bear the toner image formed by the image forming unit;

a movable conveying belt configured to convey a recording material;

a transfer member configured to transfer, in a transfer portion, the toner image from the image bearing member to the recording material which is conveyed by the conveying belt;

a power supply configured to apply a voltage to the transfer member;

a first blade member disposed downstream of the transfer portion and upstream of the image forming unit in a direction in which the image bearing member moves and configured to be in contact with the image bearing member;

a second blade member configured to be in contact with the conveying belt; and an execution unit configured to form a toner band, in a non-image area existing between image areas of the image bearing member when toner images are formed continuously, with first density when information about toner usage in an image formation is equal to or greater than a predetermined amount, and with second density which is higher than the first density when the information is smaller than the predetermined amount, and configured to set a toner band passing voltage in accordance with the information, wherein the toner band passing voltage is a voltage applied to the transfer member from the power supply when the toner band passes the transfer portion and has the same polarity as that of the voltage applied to the transfer member when the toner image is transferred.

8. The image forming apparatus according to claim 7, wherein the information about the toner usage is in accordance with an image rate of the toner image and the number of formed images with respect to the recording material.

9. The image forming apparatus according to claim 7, wherein the image bearing member is an intermediate transfer belt.

10. An image forming apparatus, comprising:

an image forming unit configured to form a toner image;

a movable image bearing member configured to bear the toner image formed by the image forming unit;

a movable conveying belt configured to convey a recording material;

a transfer member configured to transfer, in a transfer portion, the toner image from the image bearing member to the recording material which is conveyed by the conveying belt;

a power supply configured to apply a voltage to the transfer member;

a first blade member disposed downstream of the transfer portion and upstream of the image forming unit in a direction in which the image bearing member moves and configured to be in contact with the image bearing member;

a second blade member configured to be in contact with the conveying belt; and an execution unit configured to form a toner band in a non-image area existing between image areas of the image bearing member when toner images are formed continuously, and configured to set a toner band passing voltage so that the absolute value of the toner band passing voltage when information about toner usage in an image formation is a first amount is greater than the absolute value of the toner band passing voltage when the information is a second amount which is smaller than the first amount, wherein the toner band passing voltage is a voltage applied to the transfer member from the power supply when the toner band passes the transfer portion and has the same polarity as that of the voltage applied to the transfer member when the toner image is transferred.

11. The image forming apparatus according to claim 10, wherein the information is in accordance with an image rate of the toner image and the number of formed images with respect to the recording material.

12. The image forming apparatus according to claim 10, wherein the image bearing member is an intermediate transfer belt.

* * * * *